US005558924A

United States Patent [19]

Chien et al.

[11] Patent Number: 5,558,924

[45] Date of Patent: Sep. 24, 1996

[54] METHOD FOR PRODUCING A CORRUGATED RESIN-BONDED OR THERMO-BONDED FIBERFILL AND THE STRUCTURE PRODUCED THEREBY

[75] Inventors: Tien-Sheng Chien, deceased, late of Taipei, Taiwan, by Jung Fu Chien, legal representative; Jung-Fu Chien; Paul C. Chien, both of Montebello, Calif.; Hsiu-Lan Lu, Taipei Hsien, Taiwan

[73] Assignee: Shinih Enterprise Co., Ltd, Taipei, Taiwan

[21] Appl. No.: 293,239

[22] Filed: Aug. 19, 1994

Related U.S. Application Data

[63] Continuation-in-part of Ser. No. 841,805, Feb. 26, 1992, abandoned, Ser. No. 246,880, May 20, 1994, and Ser. No. 246,953, May 20, 1994, abandoned.

[51] Int. Cl.[6] ..... D04H 1/70

[52] U.S. Cl. ..... 428/181; 19/163; 156/62.2; 156/62.6; 156/205; 156/210; 428/179; 428/183; 428/184; 428/288; 428/295; 428/296; 428/300; 428/301; 428/302

[58] Field of Search ..... 156/62.6, 210, 156/205, 470, 474, 62.2; 19/163; 428/179, 181, 183–184, 288, 295–296, 300–302

[56] References Cited

U.S. PATENT DOCUMENTS

| | | | |
|---|---|---|---|
| 1,988,843 | 1/1935 | Heldenbrand . | |
| 2,428,709 | 10/1947 | Hlavaty . | |
| 2,684,107 | 7/1954 | Schultz . | |
| 2,689,811 | 9/1954 | Frederick et al. . | |
| 3,227,592 | 1/1966 | Coates et al. . | |
| 3,879,820 | 4/1975 | Grieves et al. . | |
| 4,111,733 | 9/1978 | Periers . | |
| 4,335,176 | 6/1982 | Baumann | 428/300 |
| 4,567,078 | 1/1986 | Blackmore et al. . | |
| 4,576,853 | 3/1986 | Vaughn et al. . | |
| 4,749,423 | 6/1988 | Vaalburg et al. . | |
| 4,818,599 | 4/1989 | Marcus . | |
| 4,957,805 | 9/1990 | Biggs et al. . | |
| 5,057,168 | 10/1991 | Muncrief . | |

FOREIGN PATENT DOCUMENTS

| | | | |
|---|---|---|---|
| 179451 | 4/1986 | European Pat. Off. . | |
| 350627 | 1/1990 | European Pat. Off. . | |
| 558205 | 9/1993 | European Pat. Off. . | |
| 4746030 | 11/1972 | Japan . | |
| 146063 | 11/1990 | Taiwan . | |
| 172294 | 11/1991 | Taiwan . | |
| 1286416 | 1/1987 | U.S.S.R. | 428/181 |
| 2077786 | 12/1981 | United Kingdom . | |
| 2219737 | 12/1989 | United Kingdom . | |

*Primary Examiner*—Jeff H. Aftergut
*Attorney, Agent, or Firm*—Leydig, Voit & Mayer

[57] ABSTRACT

A method is provided for forming a corrugated structure from a fibrous web by first forming a fibrous web; alternatingly lapping the fibrous web; folding the fibrous web to form corrugations; brushing fibers from one corrugated peak to extend to an adjacent peak and bridge the gap therebetween; spraying resin on the corrugated fibrous web; heating the resin-sprayed corrugated fibrous web; or further sandwiching said fibrous web with a pair of outer webs with resin sprayed thereon and heating said sandwiched fibrous web. Another embodiment initially combines fibers of low melting point with regular fibers and heats the corrugated fibrous web after brushing, rather than spraying resin on the corrugated fibrous web.

16 Claims, 9 Drawing Sheets

FIG.9B
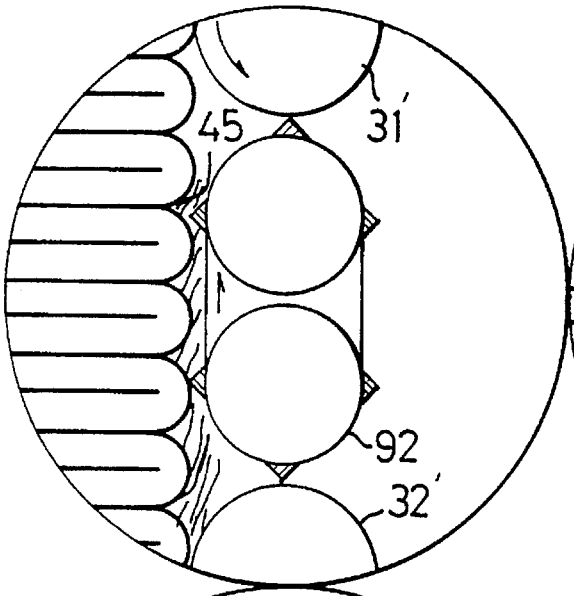
FIG.9D
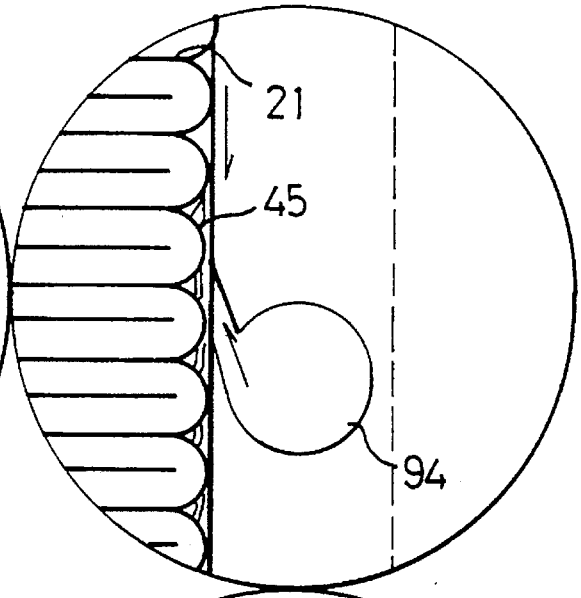
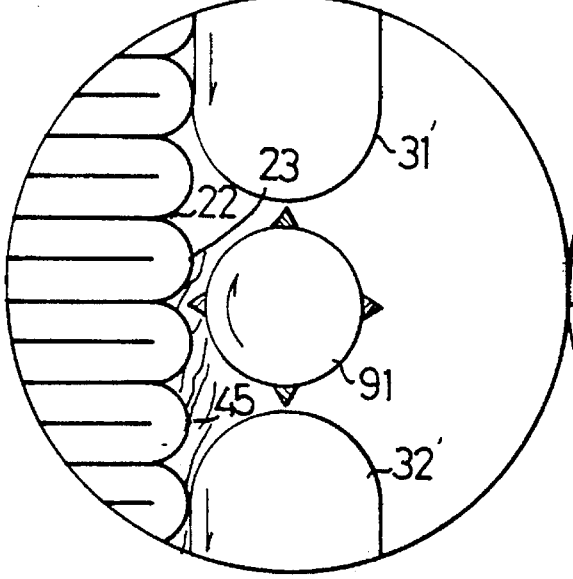
FIG.9A
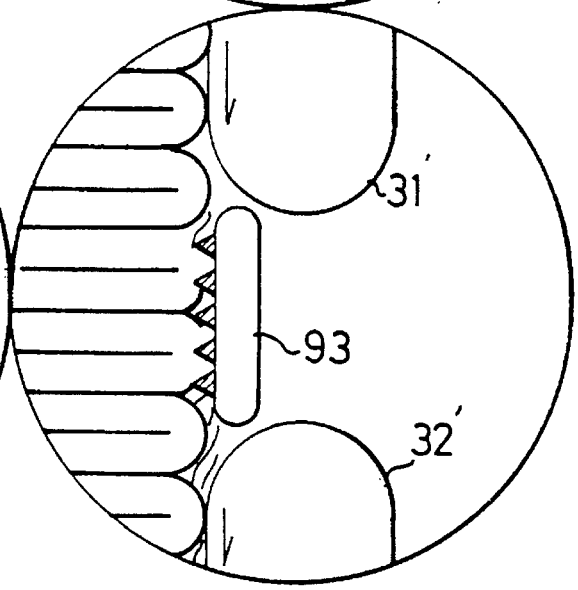
FIG.9C

METHOD FOR PRODUCING A CORRUGATED RESIN-BONDED OR THERMO-BONDED FIBERFILL AND THE STRUCTURE PRODUCED THEREBY

This is a continuation-in-part application of prior applications Ser. Nos. 07/841,805, filed Feb. 26, 1992, now abandoned, 08/246,880, pending, and 08/246,953, now abandoned, the last two mentioned applications filed concurrently on May 20, 1994.

FIELD OF THE INVENTION

The present invention relates to a method for corrugating bonded fiberfill, especially to a resin-bonded or thermo-bonded fiberfill structure formed therefrom.

BACKGROUND OF THE INVENTION

According to a known method, shown in FIG. 1, after opening a bale and carding fibers to form a web A, the web A is shaped into zig-zag lamination A' to create strength in both longitudinal and transverse directions. This is accomplished by sequentially conveying belts B, C, and D, which transversely convey the web A. Belt E conveys longitudinally, whereas conveying belts C and D independently reciprocate transversely. After the zig-zag lamination A' is shaped by cross-lapping, resin is sprayed on the lamination A'; thereby penetrating and bonding the lamination A'. However, the prior process possesses the following drawbacks:

1. The thickness of the web A' must differ with various applications. The thickness of the lamination A' depends on the number of single webs A present, i.e., the manufacturing conditions must be controlled under a higher conveying speed of conveying belts B, C, and D; a higher transverse moving speed of conveying belts of C and D; and/or a lower speed of conveying belt E. Regarding a specification of 500 g/m$^2$ of the bonded fiberfill, the resulting cross angle of lamination A' is small or even nearly zero, thereby maintaining transverse strength but, at the same time, decreasing longitudinal strength. Accordingly, the performance of the final product is inferior with regard to the longitudinal strength.
2. Taking a carding web of 20 g/m$^2$, for example, a final product having a thickness of 500 g/m$^2$ necessitates 25 layers of card web, thereby resulting in low productivity, poor resin-penetration, and making it difficult for the zig-zag lamination A' to bond together.
3. Conventional resin-bonded fiberfill only provides strength with respect to the transverse and longitudinal directions but lacks three-dimensional strength. Therefore, the final products possess poor anti-compression properties, etc.

It is the purpose of the present invention, therefore, to mitigate and/or obviate the above-mentioned drawbacks in the manner set forth in the detailed description of the preferred embodiment.

SUMMARY OF THE INVENTION

Accordingly, it is an object of this invention to provide a method for corrugating bonded fiberfill which enhances three-dimensional strength and resilience of the final product.

Another object of this invention is to provide a method for corrugating bonded fiberfill which allows excellent penetration of resin and hot air by means of resin bonding or thermo-bonding, thereby resulting in products having increased strength.

Another object of this invention is to provide an improved structure of resin-bonded or thermo-bonded fiberfill which possesses enhanced properties of anti-compression and air permeability, for use in products such as quilts, pillows, cushioned seats, cushions, mattresses, sleeping bags, ski jackets, etc. and as filtering material.

A further object of this invention is to provide an improved structure of resin-bonded or thermo-bonded fiberfill which supplies an alternative thickness by regulating the corrugated fiber web, thereby maintaining anti-compression and air permeability.

An additional object of the present invention is to produce a fiberfill product having a smooth and even surface.

Yet another object of the present invention is to provide an improved fiberfill structure in which strength is improved in the machine direction on the surface of the structure while retaining the vertical strength in the remaining corrugations.

Still another object of the present invention is to produce a corrugated fiberfill structure which may be of low density, good stuffability, high bulk recovery when unloaded, low bulk under load, extremely soft feel and having a drape suitable for products such as comforters, sleeping bags and apparel.

Further objects and advantages of the present invention will become apparent with the description that follows.

BRIEF DESCRIPTION OF THE DRAWINGS

FIGS. 9A, 9B, 9C and 9D show various embodiments of the brushing device illustrated in FIG. 8;

DETAILED DESCRIPTION OF THE PREFERRED EMBODIMENTS

Figure 1:
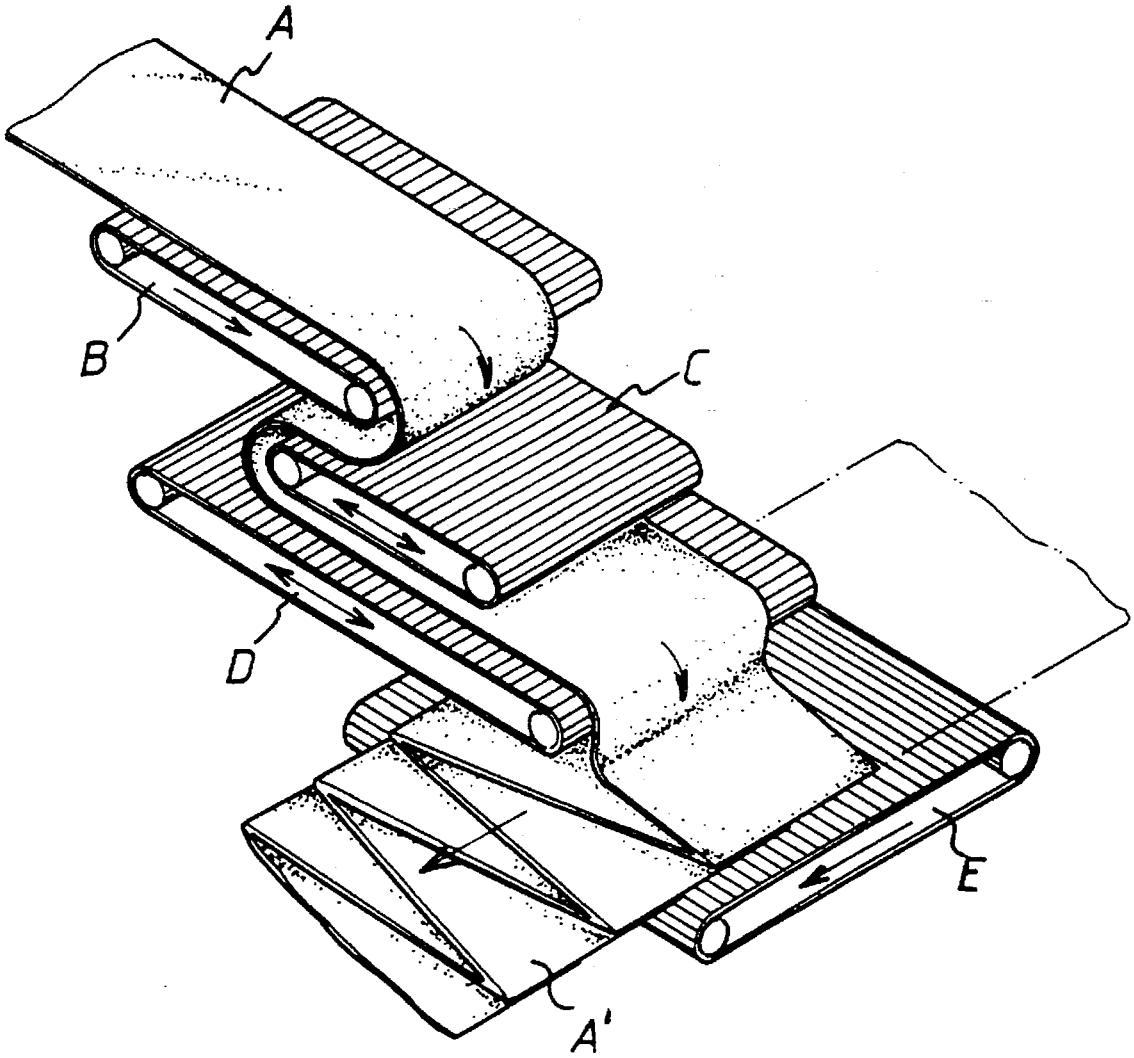
FIG. 1 PRIOR ART
FIG. 1 is a perspective view of a known cross-lapping machine.
Figure 2:
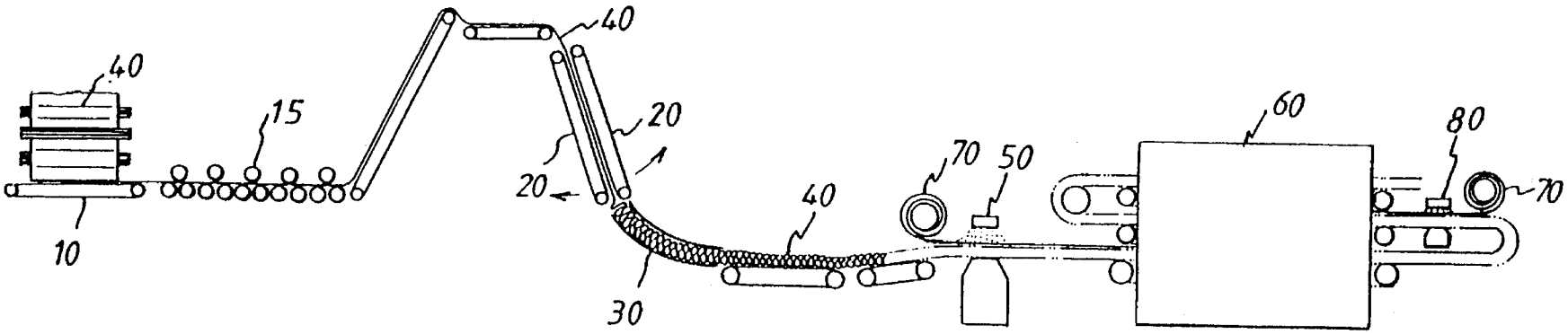
FIG. 2 is a schematic view of an apparatus for corrugating resin-bonded fiberfill according to the present invention.

Now referring to the drawings, initially to FIG. 2, a preferred embodiment of an apparatus for implementing a method for corrugating resin-bonded or thermo-bonded fiberfill in accordance with the present invention is shown. The method proceeds as follows.

A bale of fibers is initially opened, carded, and formed into a fibrous web, which is indicated by reference numeral 40. The fibrous web 40 is fed into a cross-lapping machine 10 which laps the fiber web 40 in alternating directions.

After leaving the cross-lapping machine 10, the fibrous web 40 is preferably drafted by a drafting machine 15, thereby increasing the longitudinal strength thereof. The fibrous web 40 is conveyed between a pair of parallel-spaced conveyor belts or rollers 20. The conveyor belts or rollers 20 pivot about an axis at the entrance thereto, (i.e., the belts of rollers are pivoting conveyor means) as shown by the arrows in FIG. 2, so that as the fibrous web 40 exits therefrom, the pivoting motion folds the fibrous web 40 at the laps formed by the cross-lapping machine 10, forming a corrugated structure as the fibrous web 40 enters a forming chamber or conveying passage 30, which typically contains one or more pair of parallel-arranged conveyors, such as conveyor belts. The conveying passage 30 has a height set at a predetermined height desired for the corrugations of the fibrous web 40 to yield the corrugated blanket. Thus, the cooperation of the pivoting conveyor 20 and the forming chamber 30 determines the height, pitch and orientation of the corrugations.

At this point, to the fibrous web 40, in the form of a corrugated blanket, is optionally applied a first outer web 1, which is conveyed from a first roller 70 and then passes into a spraying machine 50, where resin is sprayed onto one side of the first outer web 1. Then, the fibrous web 40 having the first outer web 1 thereon is heated and dried by an oven 60. Preferably, only a single heating step is used in the process. After leaving the oven 60, a second outer web 1, which is conveyed from a second roller 70, is applied to the fibrous web 40 and the fibrous web then passes into a spraying machine 80, where resin is sprayed onto the second outer web 1. Again, the fibrous web 40, having two outer webs 1 thereon, is heated and dried by the oven 60. The resin will adhere the corrugations 21, as shown in FIG. 5. The first and second outer webs 1 can be optionally applied to the fibrous web 40 after passing into the spraying machines 50 and 80, respectively. Alternatively, products possessing no sandwich structure, as shown in FIG. 4, can be manufactured by deleting the step of applying the two outer webs 1 on the fibrous web 40.

Figure 4:
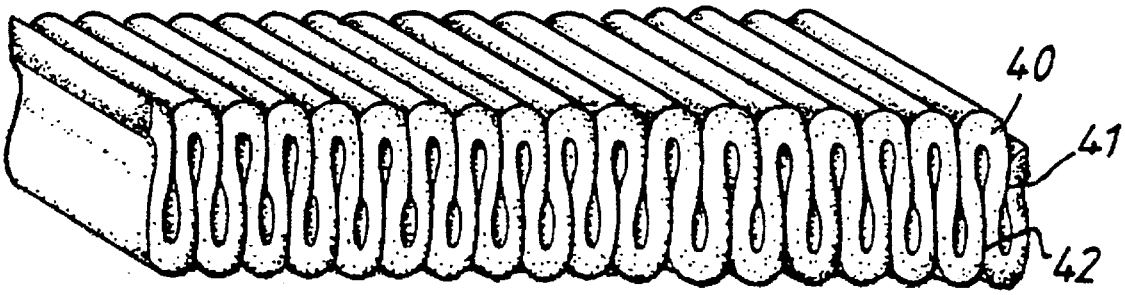
FIG. 4 is a perspective view of an improved structure of resin-bonded or thermo-bonded fiberfill according to the present invention.
Figure 5:
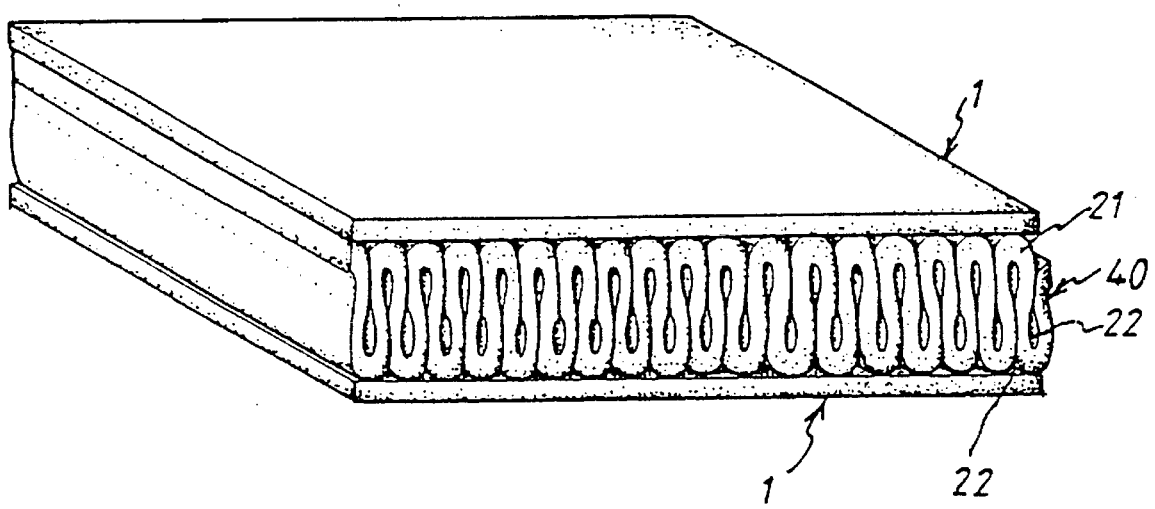
FIG. 5 is a perspective view of an embodiment of the present invention produced in accordance with apparatus shown in FIG. 3.

FIG. 4 provides a perspective view of the product having no sandwich structure. The fibrous web 40 possesses strength along the three-dimensional axes thereof, significantly increasing the strength and resilience of the overall structure. Furthermore, the spaces between the contact sites 41 and 42 of the corrugations allow resin to be uniformly dispersed and penetrate throughout the structure, which subsequently facilitates the drying and curing process.

Figure 3:
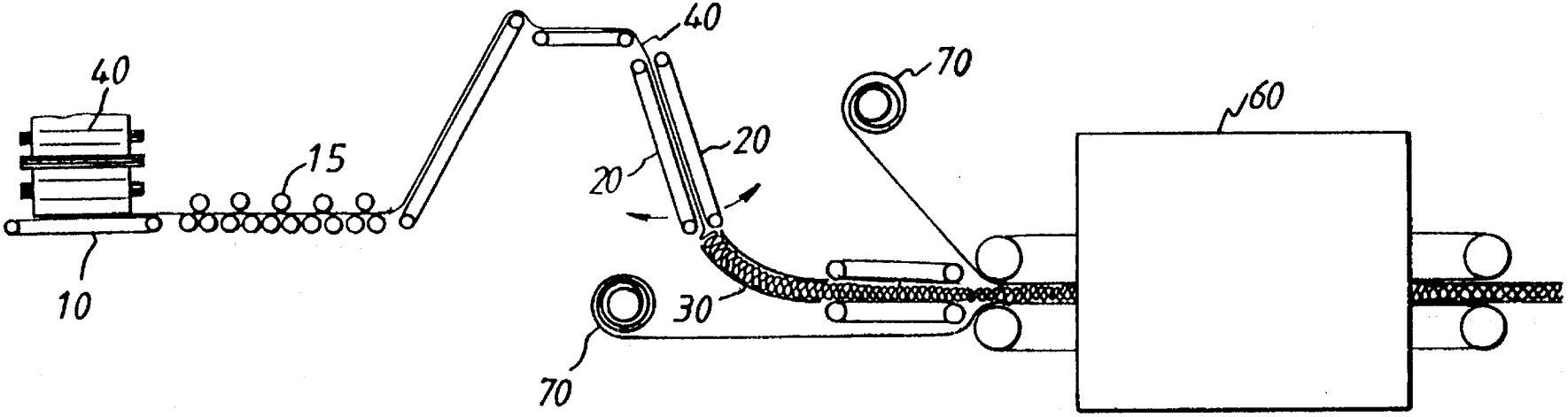
FIG. 3 is a schematic view of an apparatus for corrugating thermo-bonded fiberfill according to the present invention, optionally with another two outer webs adhering to the corrugated fiber web.

If no resin is added, according to the process schematically illustrated in FIG. 3, fibers of low melting point (second fibers) will be blended into regular fibers (first fibers) before the process is started. The molten fibers bond the corrugations and the regular fibers together. Upon cooling of the corrugated blanket, the melted fibers solidify to strongly bond the high melting fibers to one another as well as adjacent corrugations in mutual contact. Before passing into the oven 60, the corrugated fibrous web 40 is optionally sandwiched with a pair of transversely-positioned outer webs 1, respectively conveyed from two rollers 70. The sandwich structure passes into the oven 60, thereby bonding the outer webs 1 on the fibrous web 40.

Figure 6:
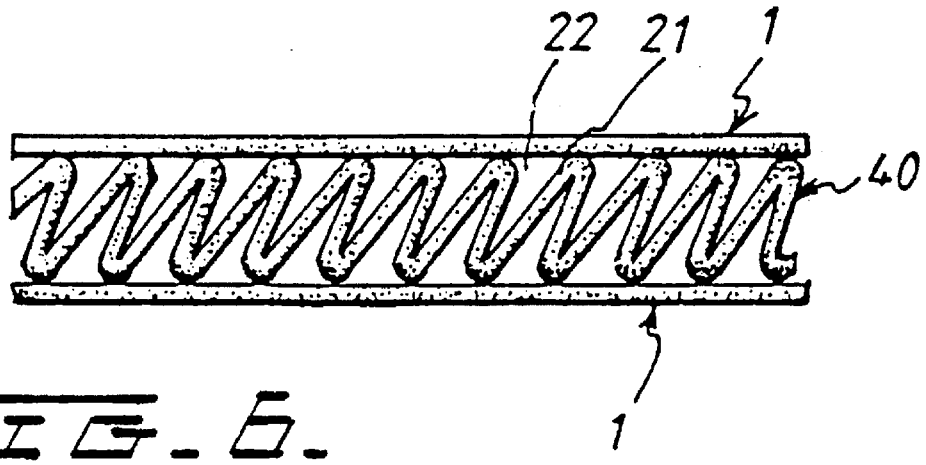
FIG. 6 is a side view of another embodiment in accordance with the present invention, wherein a fiber web has a saw tooth-like corrugated arrangement.
Figure 7:
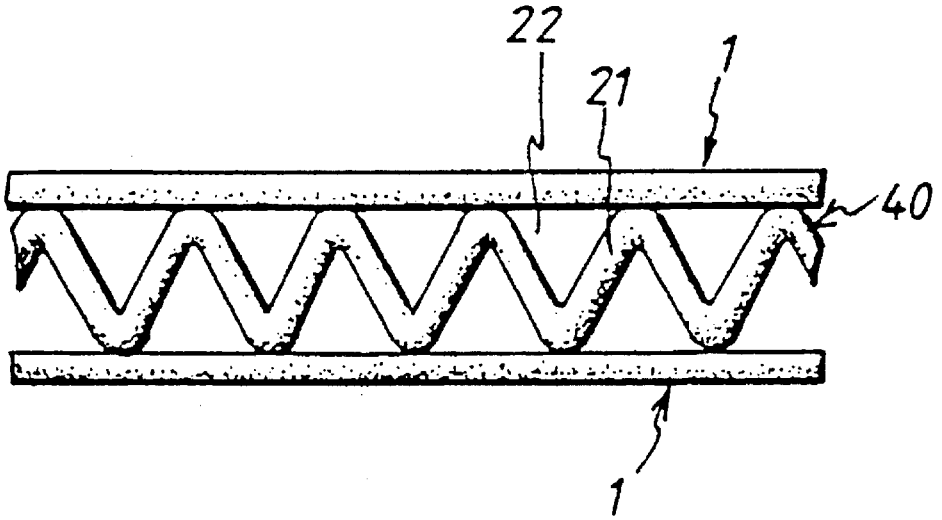
FIG. 7 is a side view of yet another embodiment in accordance with present invention, wherein the fiber web is triangularly corrugated.

Preferably as shown in FIG. 5, corrugations 21 of the fibrous web 40 are arranged accordion-like, where top and bottom ends thereof are generally rounded, with respective inner and outer spaces 22 formed between respective corrugations 21 and the outer webs 1. Also, in accordance with the present invention, the corrugations 21 of the fibrous web 40 can be saw tooth-shaped or triangularly-shaped, as respectively shown in FIGS. 6 and 7.

Additional embodiments of the present invention are illustrated in FIGS. 8 to 11. These embodiments are variations of the resin-bonded and thermo-bonded corrugated structures and methods of making such structures described above. Each of these modified embodiments involves brushing peaks 23 of the corrugations 21, thereby causing fibers 45 at or adjacent the peaks 23 of the corrugations to be pulled loose from the fibrous web 40, orient themselves across the gaps 22 existing between the peaks 23 of the corrugations to contact, and possibly become entwined with, the fibers 45 of the adjacent peak 23 of the fibrous web 40. The brushing step of the present invention is conducted after the alternately lapped fibrous web is folded so as to form a corrugated fibrous web and before either resin is applied to the corrugated web in the formation of a resin-bonded corrugated fibrous web or the heating step in the formation of a thermo-bonded corrugated fibrous web.

To obtain the bridging corrugated, fibrous webs of the present invention, the peaks 23 are brushed once the corrugated structure is formed. This is achieved by locating one or more brushing apparatus or brushes 90 within the conveying passage or forming chamber 30. The forming chamber 30 includes at least one pair of parallel-spaced conveyors 31 at the downstream end of which is positioned one or more brushing apparatus 90.

Figure 8:
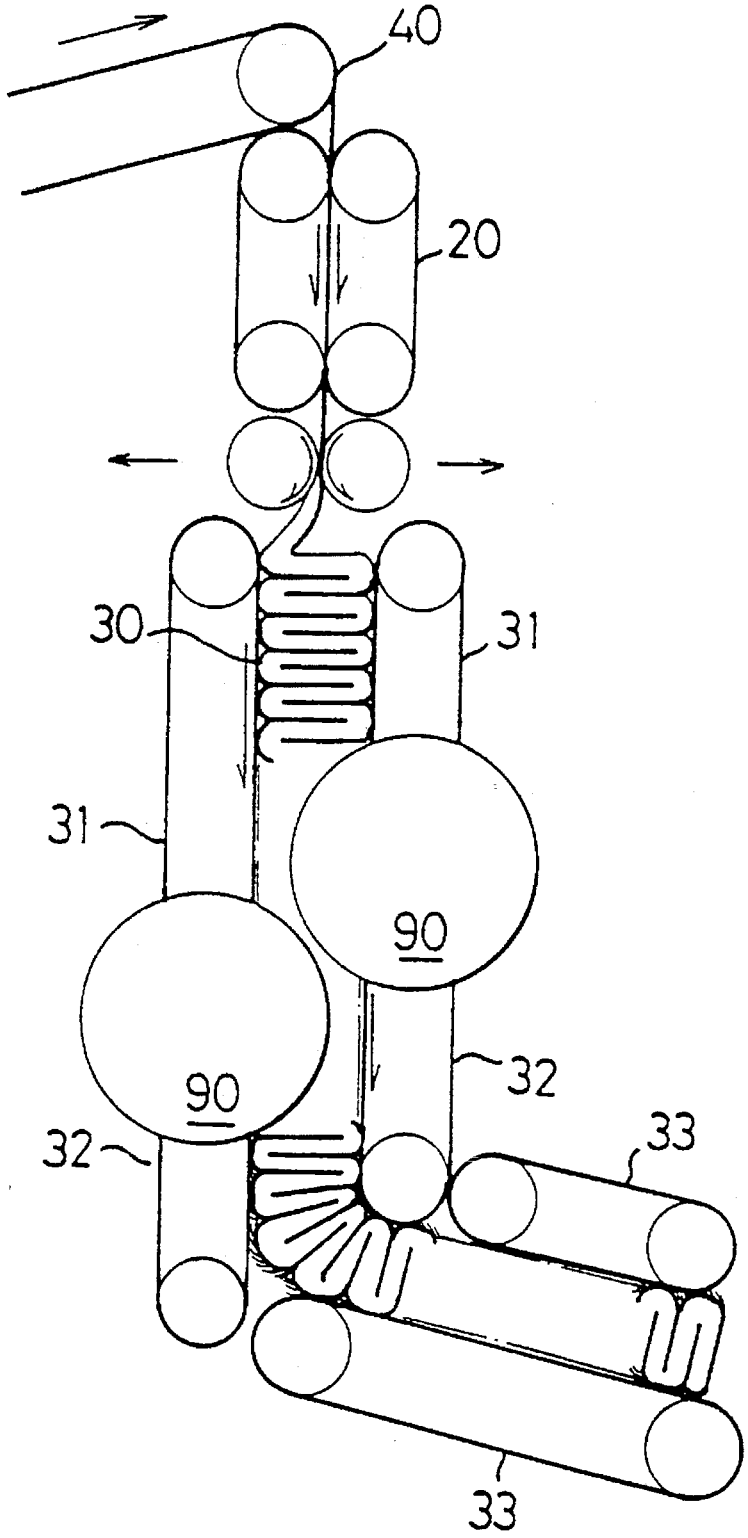
FIG. 8 is a schematic view of the portion of an apparatus for corrugating resin-bonded or thermo-bonded fiberfill according to an embodiment of the present invention.
Figure 11:
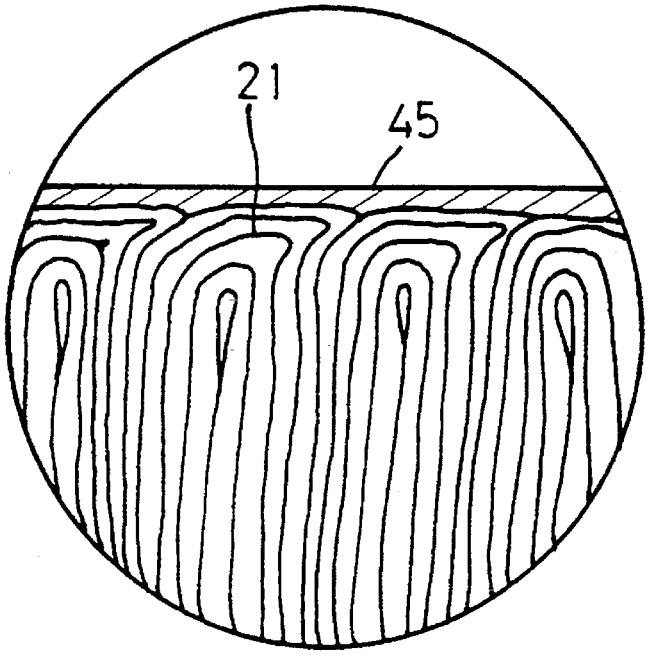
FIG. 11 is an enlarged portion of the region of the fiberfill product illustrated in FIG. 10 at the peaks of the fiberfill portion.
Figure 10:
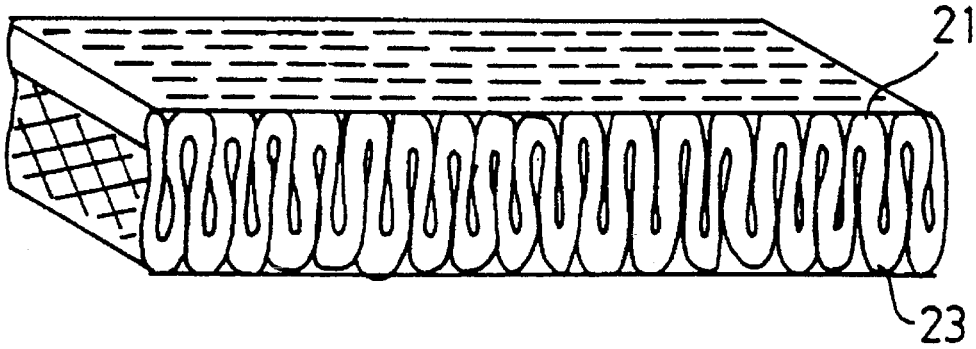
FIG. 10 is a perspective view of the fiberfill material produced with the apparatus of FIG. 8.

Preferably, as illustrated in FIG. 8, the system of the present invention employs at least two pair of parallel-spaced conveyors, such as conveyor belts 31, 32, and 33, 34 arranged in series in the conveying passage 30. Preferably, the brushing apparatus 90 is positioned between first and second pairs of parallel-arranged conveyors. Optionally, additional brushing apparatus may be located intermediate successive pairs of parallel-spaced conveyors. While each individual conveyor in a pair of parallel-spaced conveyors, such as 31, 32 or 33, 34, may be of the same length, as measured in the direction of movement of the fibrous web 40, it is preferred that the length of each conveyor be different. This permits a skewed arrangement of each brushing apparatus 90 as illustrated in FIG. 8. In such an arrangement, while a brushing apparatus 90 is applying force to a peak 23 on one side of the corrugated fibrous structure, support is provided by the belt of the conveyor on the opposite surface of the moving, corrugated fibrous web.

Various types of brushing apparatus may be employed in the present invention. Examples of such brushing apparatus are illustrated in FIGS. 9A to 9D. The particular type of brushing apparatus selected and positioning with respect to the peaks 23 of the corrugations of the fibrous web 40 are based, at least in part, on variables such as the material from which the fibrous web is formed, the length of the fibers, the density of the fibrous web, how tightly the corrugations are arranged, etc. Exemplary of the types of brushes employed as the brushing apparatus 90 include rotating brushes 91, of the type illustrated in FIG. 9A in which radially-oriented bristles rotate about an axis.

An alternative embodiment is illustrated in the conveyor brush 92 of FIG. 9B. In the conveyor brush 92, a conveyor belt is provided with outwardly projecting bristles. The conveyor belt being mounted on and extending between a rotating, driving wheel or pulley and a driven wheel or pulley. Although the rotating and conveyor brushes, 91 and 92, respectively, may be arranged so as to rotate in the direction of movement of the corrugated fibrous web 40, it is generally preferred that rotation occur in the direction opposite that of the direction of movement of the corrugated fibrous web 40, as illustrated by the arrows shown in FIGS. 9A and 9B.

Other exemplary types of brushes suitable for use in the present invention include the fixed brush 93 illustrated in FIG. 9C and the air "brush" 94 illustrated in FIG. 9D. The latter type of brushing apparatus includes one, or a plurality of nozzles oriented toward the surface of the peaks 23 of the corrugations. As with the rotating brush, the nozzles of the air brush 94 are preferably oriented counter to the direction of movement of the fibrous web 40. Air, under suitable pressure, is passed through the nozzles in a manner to lift ends of fibers 45 from the surface of the fibrous web 40, in a manner similar to that achieved by the brushing devices 91 to 93. A single difference between the air brush 94 and the brushing devices 91 to 93 is that in addition to locating the air brush between adjacent conveyors, such as 31 and 32, if a conveyor is provided having the form of an open mesh, the air brush may be located within the space defined by the endless loop of the conveyor belt. In such an instance, air passes through the nozzle(s) of the air brush 94 and contacts the fibers 45 after passing through the open mesh of the conveyor belt. As illustrated in FIGS. 9A to 9D, showing the various brushing devices in an embodiment of the process of the present invention, and in FIGS. 10 and 11, which illustrate the fiber-bridging corrugated fibrous webs of the present invention, it may be seen that portions of fibers 45 extend from peaks 23 or a region of a corrugated fibrous web 40 adjacent such peaks, to adjacent corrugated peaks 23, bridging the gaps 22 between adjacent corrugations.

In effect, the brushing frees ends of fibers 45 from the fibrous web and "sweeps" the free ends of the fibers to adjacent peaks of the corrugated web. While freeing one end of a fiber to bridge the gap 22 between the corrugations 21, the remaining portions of the fibers 45 remain anchored to the original top of the peak 23 or region of the fibrous web 40 adjacent thereto. Once resin is applied to the pleated fibrous web and cured, or heat is applied to the pleated fibrous web in the thermo-bonded embodiment so as to bond various fibers together, the bridging fibers 45 serve as an outer web between which the corrugated fibrous web 40 is sandwiched. Thus, while additional transversely-positioned outer webs 1 may be applied to the outer surface of the bridging fibers 45, this is frequently unnecessary since the bridging fibers 45, after curing of the resin or melting and subsequent solidification and bonding of fibers in the thermo-bonding embodiment, achieve, among others, many of the objects of the embodiments described above having the transversely-positioned outer webs 1, without the additional step of applying the transversely-positioned outer webs nor the associated complexity of including apparatus for applying the webs. Nonetheless, in some instances, it may be desirable to not only include the fiber-bridging corrugated fibrous web, but also include such structure sandwiched between a pair of transversely-positioned outer webs 1 or to affix such transversely-positioned outer web 1 to a single surface of the bridging fibers 45.

Overall, the structure of the present invention has a high degree of air permeability, anti-compression, and loftiness, and is useful in quilts, pillows, cushioned seats, cushions, mattresses, sleeping bags, snow clothing, etc. and as filtering material.

Particular advantages realized by the fiber-bridging corrugated fibrous structures of the present invention include structures having a smooth and even surface resulting from at least partially filling the gaps between adjacent pleats of the structure. The fiber-bridging structures also have improved machine directional strength as compared to conventional structures, resulting from the increased bonding of adjacent pleats, while still retaining the strength and structural properties related to the vertical portions of each pleat.

In resin-bonded structures, application of the resin to only the surface portions of the fiber-bridging pleated structures is necessary to provide additional structural integrity to the corrugated structure. By such application of resin to only the surfaces, a low density structure having good "stuffability", high bulk recovery in an unloaded state, and low bulk under load, as well as being extremely soft may be formed. Such material is suitable for products such as comforters, sleeping bags, and apparel, providing good insulation and suitable hand. This may be compared with conventional corrugated products which must be saturated with resin to provide suitable, structural integrity. Such saturated resin products possess high density and may be used for the manufacture of mattresses and furniture cushions, but not the types of low density products for which an embodiment of the fiber-bridging resin-bonded, corrugated structures of the present invention may be used.

In the fiber-bridging, thermo-bonded corrugated fiber structures of the present invention, in addition to the machine directional strength achieved by the bridging fibers, such bridging fibers also serve as a frame which holds the corrugations in place. As a result, the structure does not need the corrugations arranged in a closely spaced arrangement as required by conventional corrugated structures. This also results in softer, lower density material suitable for sleeping bags and apparel.

While the present invention has been explained in relation to its preferred embodiments, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A method for forming a corrugated, resin-bonded structure comprising:

(a) lapping a fibrous web in alternating directions to form alternating laps;

(b) folding said fibrous web to form a corrugated fibrous web;

(c) brushing peaks of said corrugated fibrous web so that fibers from one peak of said corrugated fibrous web extend to an adjacent peak, bridging a gap formed therebetween;

(d) applying resin to said corrugated fibrous web; and (e) heating said corrugated fibrous web so that said corrugated fibrous web maintains said corrugations.

2. A method as claimed in claim 1 wherein said resin is applied to said fibers extending from said one peak to an adjacent peak.

3. A method as claimed in claim 1, further comprising a step after said step (a) of drafting said fibrous web, such that the longitudinal strength of said fibrous web is increased.

4. A method as claimed in claim 1, further comprising a step after said step (c) of sandwiching said corrugated fibrous web with a pair of transversely-positioned outer webs.

5. A method as claimed in claim 1 wherein folding said fibrous web to form said corrugated fibrous web comprises folding said fibrous web into corrugations with a pivoting conveyor as the fibrous web enters a conveying passage.

6. A method as claimed in claim 5 wherein the height of said conveying passage is arranged to correspond to the desired height of the corrugations.

7. A method as claimed in claim 1, further comprising a step before said step (a), including carding fibers to form said fibrous web.

8. A method for forming a corrugated, thermo-bonded fiberfill structure comprising:

(a) lapping a fibrous web formed from first fibers and second fibers in alternating directions to form alternating laps;

(b) folding said fibrous web to form a corrugated fibrous web;

(c) brushing peaks of said corrugated fibrous web so that fibers from one peak of said corrugated fibrous web extend to an adjacent peak, bridging a gap formed therebetween;

(d) heating said corrugated fibrous web such that said second fibers, having a low melting point, bond said corrugations and said first fibers together.

9. A method as claimed in claim 8, further comprising a step after said step (a) of drafting said fibrous web, such that the longitudinal strength of said fibrous web is increased.

10. A method as claimed in claim 8, further comprising a step after said step (c) of sandwiching said corrugated fibrous web with a pair of transversely-positioned outer webs.

11. A method as claimed in claim 8 wherein folding said fibrous web to form said corrugated fibrous web comprises folding said fibrous web into corrugations with a pivoting conveyor as the fibrous web enters a conveying passage.

12. A method as claimed in claim 11 wherein the height of said conveying passage is arranged to correspond to the desired height of the corrugations.

13. A method as claimed in claim 8, further comprising a step before said step (a), including carding fibers to form said fibrous web.

14. A method as claimed in claim 13, further comprising a step before said step of carding fibers to form said fibrous web including blending said second fibers into said first fibers, thereby forming a blend of fibers.

15. An improved corrugated, resin-bonded structure formed by the method set forth in claim 1.

16. An improved corrugated, thermo-bonded structure formed by the method set forth in claim 8.

* * * * *